US007311416B1

(12) United States Patent
Kudma

(10) Patent No.: US 7,311,416 B1
(45) Date of Patent: Dec. 25, 2007

(54) MAKE-UP CASE

(76) Inventor: Chris Kudma, 11007 Wilson Oaks, San Antonio, TX (US) 78249

( * ) Notice: Subject to any disclaimer, the term of this patent is extended or adjusted under 35 U.S.C. 154(b) by 0 days.

(21) Appl. No.: 11/605,680

(22) Filed: Nov. 28, 2006

(51) Int. Cl.
*B65D 71/00* (2006.01)

(52) U.S. Cl. ..... 362/154; 132/293; 132/294; 132/295; 206/581; 206/823

(58) Field of Classification Search ..... 362/154, 362/155, 253; 206/581, 823; 132/288, 293–297, 132/300, 301, 314, 317, 318
See application file for complete search history.

(56) References Cited

U.S. PATENT DOCUMENTS 1,534,871 A * 4/1925 Roystone ..... 132/294
2,248,689 A * 7/1941 Porter ..... 132/297
3,441,033 A * 4/1969 Flax ..... 132/295
3,559,854 A * 2/1971 Loveland ..... 224/219
4,898,195 A 2/1990 Sussman
5,425,971 A 6/1995 Chiang-Cheng
6,293,286 B1 9/2001 Gueret
6,932,220 B2 8/2005 Byun
2004/0129599 A1 7/2004 Yi-Hung

* cited by examiner

*Primary Examiner*—Laura Tso
(74) *Attorney, Agent, or Firm*—Eric Spencer, Esq.

(57) ABSTRACT

A make-up case configured to hold a variety of cosmetic items is disclosed. The make-up case comprises a plurality of internal compartments for the storage of various predetermined cosmetic items such as for example a full size lipstick, an eye liner pencil, a lip liner pencil, a pencil sharpener, etc. In addition, a pair of cosmetic cover assemblies are provided which accept a replaceable tray of cosmetic material such as face powder, blush and eyeliner make-up.

18 Claims, 7 Drawing Sheets

MAKE-UP CASE

BACKGROUND OF THE INVENTION

This invention relates to make-up cases for housing various cosmetics and more specifically relates to a multi-compartment make-up case that has provisions to hold a pair of replaceable and interchangeable cosmetic trays, a full size lip stick, a lip liner pencil, an eye liner pencil, a pencil sharpener, and a pair of battery powered lighted mirrors.

The majority of the make-up cases available in the market today are of single-layered structure in which the cosmetic items it holds are limited. Most of the cosmetic items have to be placed in other places, causing an inconvenience to search for them when they are needed. Although multi-layered cosmetic cases are available today, their capacities to hold the cosmetic items are still limited. Items such as lipstick, eye liner, eye shadow applicator, mascaras and brow brush have to be placed in a different case. Generally, most of the makeup items are placed into one case, making it hard to identify and pick out one of the particular items. It is also messy to put all the makeup items into a single case.

Examples of patented devices which may be related to the present invention include U.S. Pat. No. 5,425,971 to Chiang-Cheng; U.S. Pat. No. 6,293,286 to Gueret; U.S. Pat. No. 6,932,220 to Byun; U.S. Pat. Application No. 20040129599 to Yi-Hung; and U.S. Pat. No. 4,898,195 to Sussman.

While these devices may be suitable for the particular purpose to which they address, there is still a need for a lightweight, easy to use make-up case that provides a means to carry a multitude of cosmetics. Prior art make-up cases are bulky, complex and difficult to effectively utilize by the consumer.

SUMMARY OF THE INVENTION

In one general aspect of the invention, a make-up case is provided comprising a first cover assembly which holds a first cosmetic tray. A second cover assembly is provided which holds a second cosmetic tray. A movable outer ring is located between the first cover assembly and the second cover assembly and an access hole is disposed on the outer ring. A plurality of compartments are provided between the first cover assembly and the second cover assembly wherein each compartment may be accessible by bringing the access hole in selectable alignment with a respective compartment.

In another general aspect of the present invention a multi-compartment make-up case which is configured to store a plurality of items is provided. A first cover assembly is provided having a hinged lid wherein the first cover assembly is configured to store a first cosmetic therein. A second cover assembly is provided having a hinged lid, the second cover assembly is configured to store a second cosmetic therein. A cylindrical outer ring is affixed to and disposed between the first cover assembly and the second cover assembly, and the cylindrical outer ring further comprises an access hole, wherein the access hole is movable to a plurality of predetermined positions. A plurality of compartments are disposed internal to the outer ring wherein each of the compartments are accessible by bringing said access hole in selectable alignment with a respective compartment.

These and other features, aspects and advantages of the invention will become better understood with reference to the following drawings, description, and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
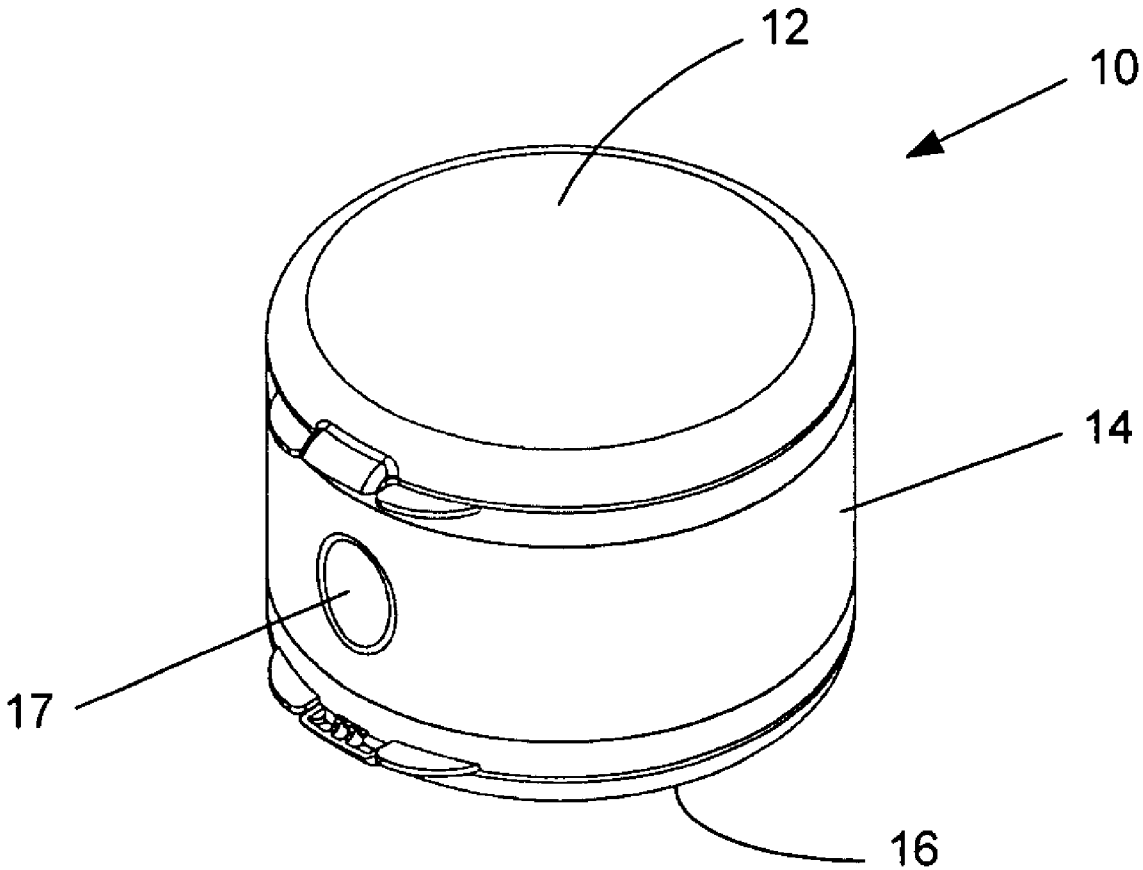
FIG. 1 is a simplified isometric view of a make-up case in accordance with the invention.

Referring first to FIG. 1, which shows generally a isometric view of a cylindrically shaped make-up case 10 in accordance with the invention. A first cover assembly 12 and a second cover assembly 16 may be disposed on opposite ends of an outer ring 14. The first cover assembly 12 and the second cover assembly 16 may be hinged to the outer ring 14 so that they may be moved between and open and closed position. A finger hole 17 is disposed on the outer ring 14 to aid in the movement of the outer ring 14. The outer ring 14 is movable to a plurality of positions for access to various compartments contained with the make-up case 10. As the outer ring 14 is moved to each specific location, an audible click may be heard and felt by the user to provide positive feedback and lock the outer ring 14 in the selected position.

Figure 2:
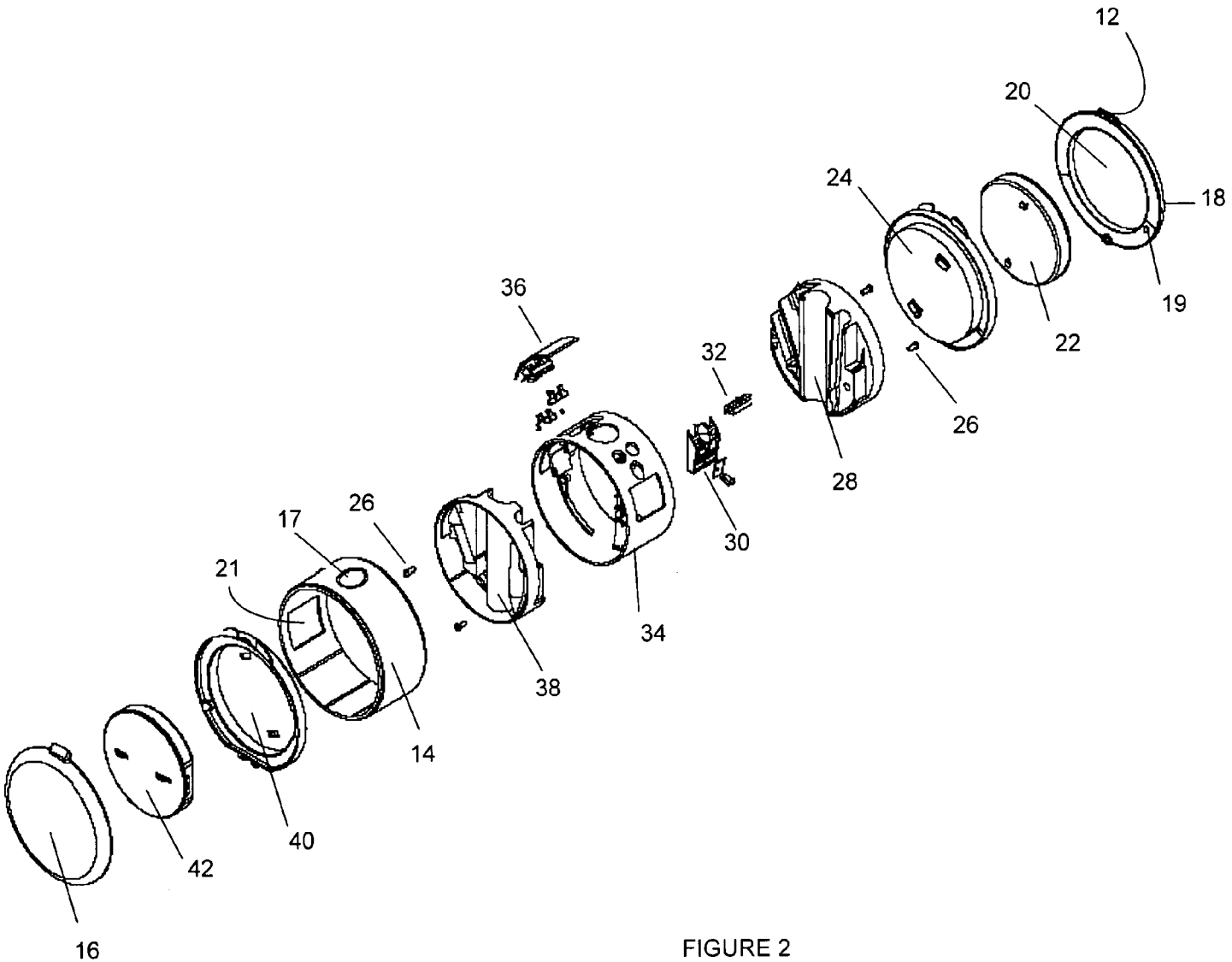
FIG. 2 is a isometric exploded view showing the various components that comprise a make-up case in accordance with the invention.

Referring now to FIG. 2, which shows generally an exploded view of the make-up case 10, both the first cover assembly 12 and the second cover assembly 16 are further comprised of a mirror 20, a light 18 and an electrical switch 19 such that when the cover assemblies 12 or 16 are placed in an open position, the light 18 automatically switches on. Alternatively, when the cover assemblies 12 or 16 are closed, the switch 19 is configured to automatically turn the light 18 off.

Disposed on the outer ring 14 is an access hole 21 that allows access to the various compartments contained in the make-up case 10 as the outer ring 14 is rotated and brought into alignment with the various compartments.

Disposed in one end of the make-up case 10 is a first replaceable tray 22 and disposed on the opposite end of the make-up case 10 is a second replaceable tray 42. The first replaceable tray 22 is removably disposed in a first tray holder 24 and the second replaceable tray 42 is removably disposed in a second tray holder 40. The replaceable trays 22 and 42 are configured to contain various cosmetic products, for example, eye shadow, face powder, blush powder or the like. The replaceable trays 22 and 42 are also configured for easy removal and replacement in the event the cosmetics contained therein are used up. In one embodiment, the replaceable trays 22 and 42 are removed by turning the tray counterclockwise and pulling up the tray to remove the empty tray from the respective tray holder 24 and/or 40. A new replaceable tray is easily installed in the make-up case 10 by reversing this process.

A first center fitting 28 is affixed to a second center fitting 38 by a plurality of fasteners 26. A center ring 34 is disposed around the periphery of the first and second center fittings 28 and 38. The first and second center fittings 28 and 38 are configured to form the various compartments contained with the make-up case 10 and various openings (to be described later) disposed on the center ring 34 are located adjacent to these compartments.

Figure 3A:
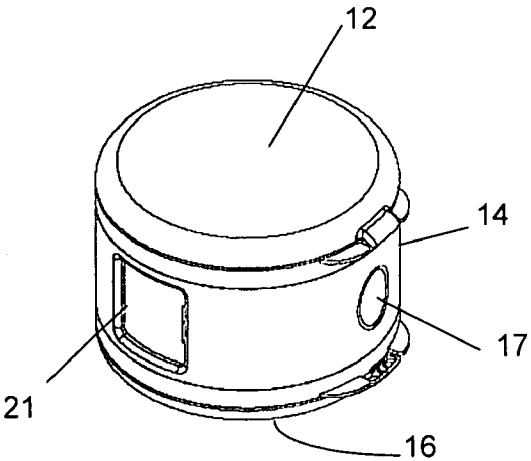
FIGS. 3A-3F are isometric views of a make-up case in various positions in accordance with the invention.
Figure 3B:
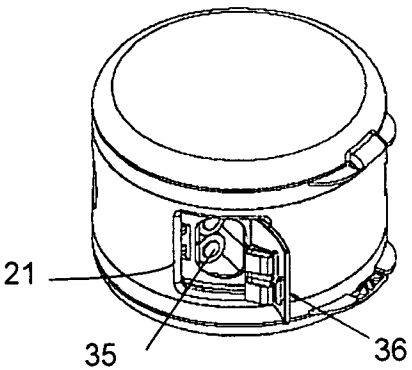
Figure 3C:
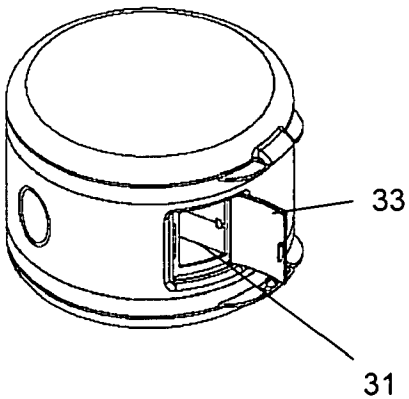
Figure 3D:
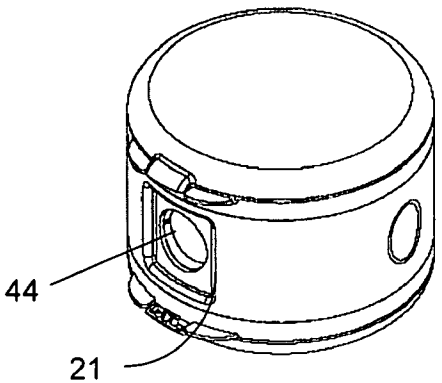
Figure 3E:
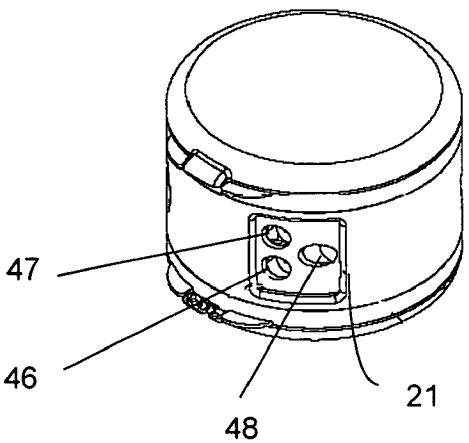
Figure 3F:
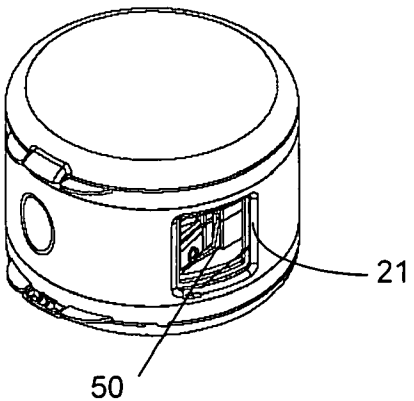

Referring now to FIGS. 3A-3F, which shows a series of isometric views of the make-up case 10 with the outer ring 14 in alignment with the various compartments contained with the make-up case 10. FIG. 3A shows the make-up case 10 in the closed position in which the access hole 21 is not in alignment with any compartment. FIG. 3B shows the make-up case in which the access hole 21 has been rotated into alignment with a battery door 36 which may be opened to allow access to a pair of batteries 35 contained therein. The batteries 35 are configured to provide power to the light 18 via the switch 19. FIG. 3C shows the access hole 21 rotated into alignment with a miscellaneous compartment 31 which may be configured to store various items such as pills or the like. A miscellaneous compartment door 33 may be provided to allow easy access to compartment 31. FIG. 3D shows the access hole 21 rotated into alignment with a lipstick compartment 44. The lipstick compartment 44 is configured to accept and hold a full size lip stick. FIG. 3E shows the access hole 21 rotated into alignment with an eyeliner pencil compartment 46, a lip liner pencil compartment 47 and a pencil sharpener compartment 48 at the same time. The pencil sharpener compartment is configured to house a pencil sharpener assembly 30 (FIG. 2) for sharpening various cosmetic pencils. FIG. 3F shows the access hole 21 rotated into alignment with a shavings compartment 50 which is configured to catch and hold shavings produced by the adjacent pencil sharpener assembly 30. With the access hole 21 placed in this position, the user can easily remove the shavings that may have collected in this compartment.

Figure 4B:
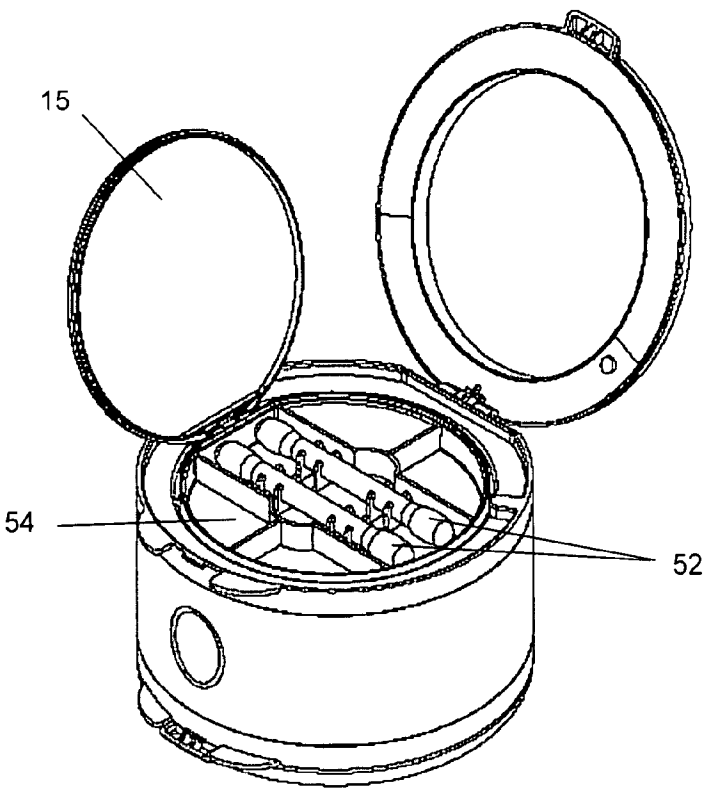
FIG. 4B is an isometric view of a make-up case with the lid of a replaceable tray in an open position in accordance with the invention.
Figure 4A:
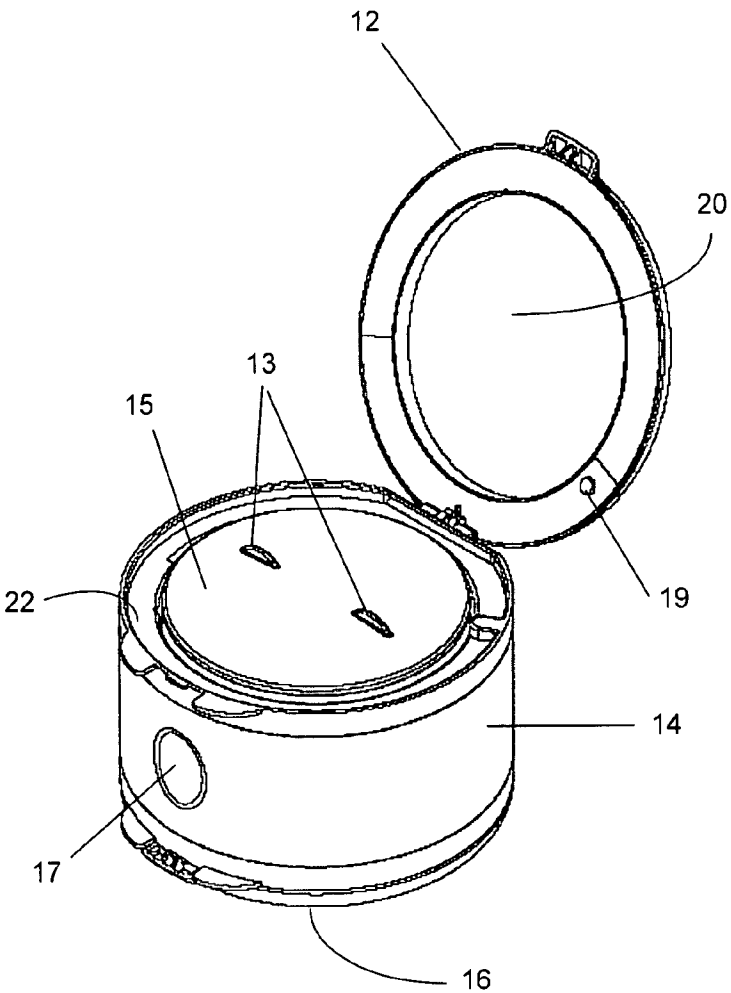
FIG. 4A is an isometric view of a make-up case with a cover in an open position in accordance with the invention.

Referring now to FIGS. 4A and 4B which shows the make-up case 10 with the first cover assembly 12 in an open position. A lid 15 is configured to open and close and is affixed to the first replaceable tray 22. A pair of lid handles 13 is provided on the outside surface of lid 15 to aid the user in removing the replaceable tray 22 from the make-up case 10 as previously described. It should be noted that the second replaceable tray 42 has similar features as well. FIG. 4B shows a replaceable tray 22 that is configured to hold eye shadow make up comprised of four eye shadow compartments 54 for holding four different colors and a pair of applicators 52 for applying the make-up as desired.

Figure 5:
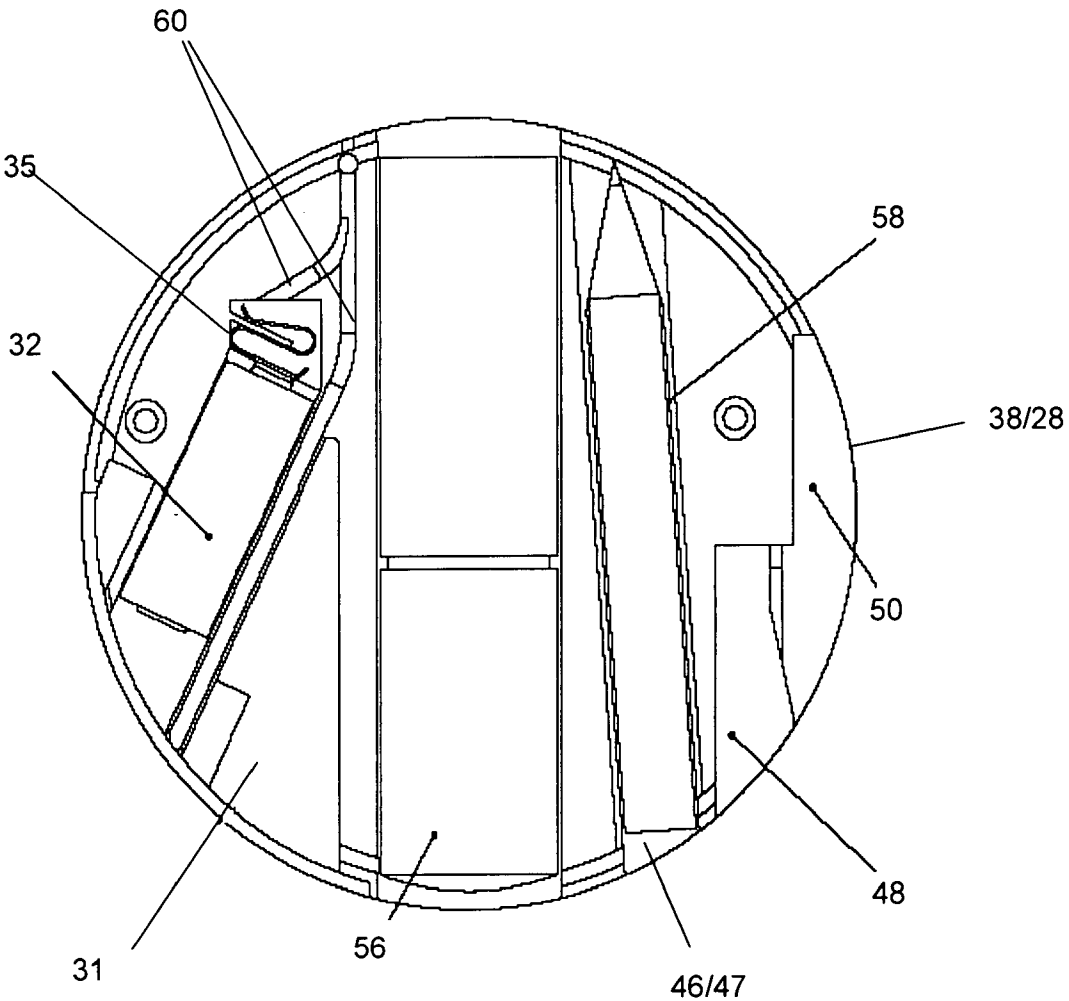
FIG. 5 is a top plan view showing the location of various compartments disposed in a make-up case in accordance with the invention.

Referring now to FIG. 5 which shows a cut away plan view of the various compartments contained in the make-up case 10. A full size lipstick 56 is disposed in the lipstick compartment 44. A pencil 58 is disposed in one of the pencil compartments 46 or 47. At least one battery 35 is disposed in the battery compartment and battery electrical contacts 32 are configured to make contact with the battery 35. Wire 60 is configured to run from the battery electrical contacts 32 to the light 18 via the switch 19 which are located in both the first cover assembly 12 and second cover assembly 16. The miscellaneous compartment is shown between the battery compartment and the lipstick compartment 44. The pencil sharpening compartment 48 is shown next to the pencil compartments 46 and 47 and the shavings compartment 50 is shown next to the pencil sharpener compartment 48.

Figure 6:
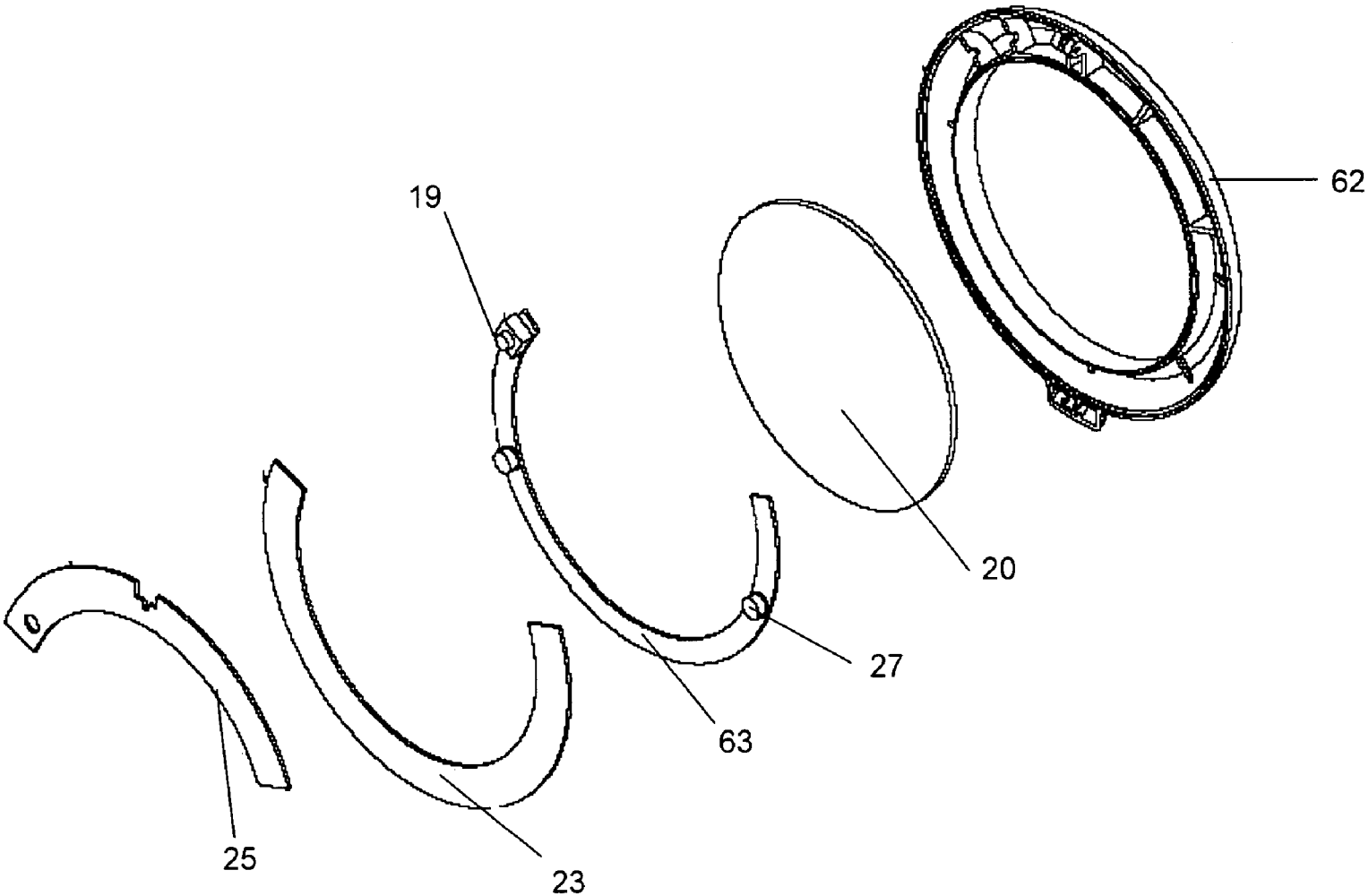
FIG. 6 is an isometric exploded view of a cover assembly in accordance with the invention.

Referring now to FIG. 6, which shows an isometric exploded view of first cover assembly 12 or second cover assembly 16. A cover assembly is comprised of a cover 62 configured to retain the mirror 20 with a circuit board 63 disposed around the periphery of the mirror 20. Disposed on the circuit board 63 is a light emitting diode (LED) 27 or the like and the switch 19 which is in electrical communication between the LED 27 and the batteries 35. A panel 25 is placed over the circuit board 63 and a diffuser 23 configured to diffuse the light coming from the LED 27 is also placed over the circuit board 63 as shown in the figure.

Figure 7:
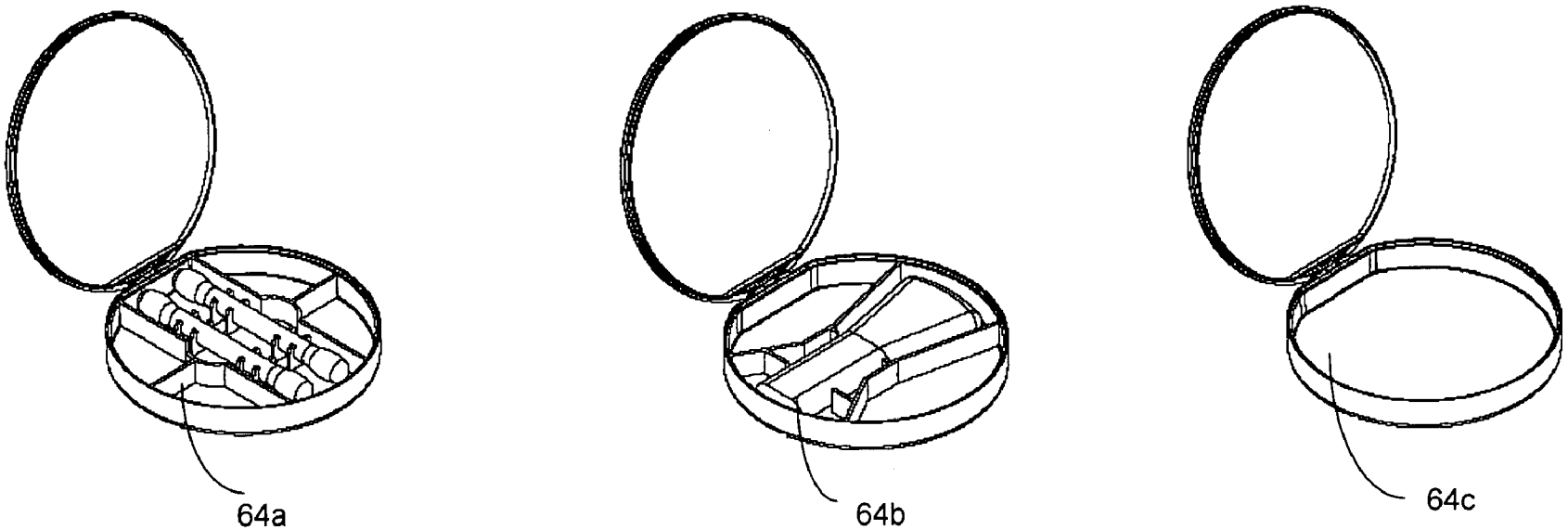
FIG. 7 is a collection of isometric views of various configurations of a replaceable cosmetic tray in accordance with the invention.

Referring now to FIG. 7, which shows as an example various configurations that may be used as the replaceable tray 22 or 42. An eyeliner tray 64*a* is shown which is configured to hold a pair of applicators and four different eye shadow colors. A blush powder tray 64*b* is shown which is configured to hold a predetermined amount of blush 65 and a blush applicator brush 66. A face powder tray 64*c* is shown which is configured to hold a predetermined amount of powder and a powder applicator (not shown). As mentioned previously, the make-up case is configured to easily accept any two of these replaceable tray configurations.

It should be understood, of course, that the foregoing relates to preferred embodiments of the invention and that modifications may be made without departing from the spirit and scope of the invention as set forth in the following claims.

What is claimed is:

1. A make-up case comprising;

a first cover assembly configured to hold a first cosmetic tray;

a second cover assembly configured to hold a second cosmetic tray;

a movable outer ring disposed between said first cover assembly and said second cover assembly;

an access hole disposed on said outer ring; and, a plurality of compartments disposed between said first cover assembly and said second cover assembly wherein each said compartment may be accessible by bringing said access hole in selectable alignment with a respective compartment.

2. The make-up case of claim 1, wherein said first cover assembly further comprises;

a cover configured to move between an open and closed position;

a mirror disposed on an inside surface of said cover;

a light disposed on said cover configured to illuminate said mirror; and, a switch disposed on said cover configured to turn said light on and off.

3. The make-up case of claim 1, wherein said second cover assembly further comprises;

a cover configured to move between an open and closed position;

a mirror disposed on an inside surface of said cover;

a light disposed on said cover configured to illuminate said mirror;

a switch disposed on said cover configured to turn said light on and off.

4. The make-up case of claim 1, wherein said first and second cosmetic tray are removable.

5. The make-up case of claim 4, wherein said first and second cosmetic tray further comprises;

a lid configured to move between an opened and closed position;

a cosmetic disposed in said cosmetic tray; and, a lid handle disposed on an outside surface of said lid, configured to aid the removal and replacement of said cosmetic tray.

6. The make-up case of claim 1, wherein said compartments are configured to hold a predetermined cosmetic item.

7. The make-up case of claim 6, wherein said cosmetic item may be one selected from the group consisting of a lipstick, an eyeliner pencil, a lip liner pencil, and a cosmetic pencil sharpener.

8. The make-up case of claim 1, wherein one of said plurality of compartments is configured to retain a battery.

9. The make-up case of claim 8, further comprising a movable door adjacent said battery configured to moved between an open and close position.

10. The make-up case of claim 1, wherein one of said plurality of compartments is configured to store pencil sharpener shavings.

11. The make-up case of claim 1, wherein said first and second cosmetic tray may comprise one selected from the group consisting of a an eyeliner tray, a blush tray and a powder tray.

12. A multi-compartment make-up case configured to store a plurality of items comprising;

a first cover assembly having a hinged lid, said first cover assembly configured to store a first cosmetic therein;

a second cover assembly having a hinged lid, said second cover assembly configured to store a second cosmetic therein;

a cylindrical outer ring affixed to and disposed between said first cover assembly and said second cover assembly, said cylindrical outer ring further comprising an access hole, wherein said access hole is movable to a plurality of predetermined positions; and, a plurality of compartments disposed internal to said outer ring wherein each said compartment may be accessible by bringing said access hole in selectable alignment with a respective compartment.

13. The make-up case of claim 12, wherein said first cover assembly further comprises;

a mirror disposed on an inside surface of said hinged lid;

a light disposed on said hinged lid configured to illuminate said mirror; and, a switch disposed on said hinged lid configured to turn said light on and off.

14. The make-up case of claim 12, wherein said second cover assembly further comprises;

a mirror disposed on an inside surface of said hinged lid;

a light disposed on said hinged lid configured to illuminate said mirror; and, a switch disposed on said hinged lid configured to turn said light on and off.

15. The make-up case of claim 12, wherein said cosmetic is refillable.

16. The make-up case of claim 15, wherein said cosmetic further comprises;

a cosmetic tray configured to hold said cosmetic;

a lid affixed to said cosmetic tray, said lid configured to move between an opened and closed position;

a lid handle disposed on an outside surface of said lid, said lid handle configured to aid the removal and replacement of said cosmetic tray.

17. The make-up case of claim 12, wherein each of said plurality of compartments may be configured to accept and retain a cosmetic item selected from the group consisting of a lipstick, an eyeliner pencil, a lip liner pencil, and a cosmetic pencil sharpener.

18. The make-up case of claim 12, wherein one of said plurality of compartments is configured to retain a battery, said battery being in electrical communication with a light disposed on said cover assembly.

* * * * *

UNITED STATES PATENT AND TRADEMARK OFFICE

CERTIFICATE OF CORRECTION

PATENT NO. : 7,311,416 B1
APPLICATION NO. : 11/605680
DATED : December 25, 2007
INVENTOR(S) : Kris Kudrna It is certified that error appears in the above-identified patent and that said Letters Patent is hereby corrected as shown below:

Title Page, Item (76) Inventors:
The last name of the inventor is misspelled:

"KUDMA" should be --KUDRNA--

Signed and Sealed this

Third Day of June, 2008

JON W. DUDAS
*Director of the United States Patent and Trademark Office*